US005297316A

United States Patent [19]

Bernhardt et al.

[11] Patent Number: 5,297,316

[45] Date of Patent: Mar. 29, 1994

[54] APPARATUS FOR PRODUCING FIBER MATERIAL OR THE LIKE WITH A PRECISE FEED WEIGHT

[75] Inventors: Siegfried Bernhardt, Bremen; Uwe Dierks, Stuhr; Wolfgang Uliczka, Schwanewede; Dietrich Menzel, Bremen, all of Fed. Rep. of Germany

[73] Assignee: Spinnbau GmbH, Fed. Rep. of Germany

[21] Appl. No.: 936,641

[22] Filed: Aug. 28, 1992

[30] Foreign Application Priority Data

Aug. 30, 1991 [DE] Fed. Rep. of Germany ..... 4128929

[51] Int. Cl.[5] ..... D01G 15/40

[52] U.S. Cl. ..... 19/105; 79/145.5

[58] Field of Search ..... 19/145.5, 145.7, 296, 19/200, 202, 203, 204, 205, 105, 0.23, 97.5, 300, 161.1; 222/56, 64, 271, 274, 282

[56] References Cited

U.S. PATENT DOCUMENTS

| | | | |
|---|---|---|---|
| 3,889,319 | 6/1975 | Roberson | 19/145.5 |
| 4,387,486 | 6/1983 | Keller et al. | 19/105 |
| 4,512,061 | 4/1985 | Hartmannsgruber | 19/300 |
| 4,657,444 | 4/1987 | Pinto | 19/105 |
| 4,694,538 | 9/1987 | Pinto et al. | 19/105 |
| 5,157,809 | 10/1992 | Genevray | 19/105 |

FOREIGN PATENT DOCUMENTS

| | | | |
|---|---|---|---|
| 309886 | 9/1955 | Switzerland | 19/204 |
| 2100304 | 12/1982 | United Kingdom | 19/0.23 |

*Primary Examiner*—Clifford D. Crowder
*Assistant Examiner*—Michael A. Neas
*Attorney, Agent, or Firm*—Hill, Steadman & Simpson

[57] ABSTRACT

An apparatus for producing fiber material or the like with a prescribable feed weight comprises a conveyor for delivering the fiber flock to a filling stack, which includes a vibrating wall extending in a vertical direction and a displaceable wall, a stationary delivery roller being arranged in a discharge region of the filling stack and a displaceable delivery roller being arranged opposite the stationary roller in the discharge region for controlling the thickness of the layer being deposited on a conveyor. The apparatus also includes a pressure sensor which is provided between the two delivery rollers, which pressure sensor provides signals for controlling the displacement of the displaceable delivery roller, the vibratory frequency for the vibrating wall of the stack and the displacement of the movable wall.

20 Claims, 5 Drawing Sheets

APPARATUS FOR PRODUCING FIBER MATERIAL OR THE LIKE WITH A PRECISE FEED WEIGHT

BACKGROUND OF THE INVENTION

The present invention is directed to an apparatus for producing fiber material or the like with a prescribable feed weight. The apparatus includes a conveyor means for delivering fiber flocks to a filling stack that comprises a vibrating wall extending in a vertical direction and a displaceable wall, said apparatus including a stationary haul-off drum being arranged in an outlet region of the filling stack, and the haul-off drum supplies the emerging fiber material to a delivery table.

An apparatus as described hereinabove is often referred to as a "vibrating stack feeder" will compress the initially flaky or fuzzy fibers. After the fibers have been compressed in the desired way, they are supplied, for example, to a fleece-forming system.

In a known vibrating stack feeder, the fiber flocks are conveyed from a material box via an ascending spiked lattice and are stripped therefrom with the assistance of stripper drums and then are supplied to a filling stack or vibrating stack, which comprises a vertically residing vibrating wall and a movable wall lying opposite to the vibrating wall. The fiber flocks are, thus, compressed between the two walls. The movable wall is manually adjustable for defining the width of the stack. A stationary pressure roll is provided at the outlet of the filling stack, and this pressure roll will deposit the compressed material onto a delivery table. Subsequently, the fiber material is supplied to an electronic scale. The vibratory motion of the vibrating wall is effected with the assistance of an eccentric drive, whereby the vibrating wall moves essentially parallel between two final positions.

An important characteristic quantity for the quality of the emerging fiber material is the feed weight. In known vibrating stack feeders, this is controlled by the height of the material column in the stack, by the width of the stack, by the vibratory frequency, by the haul-off rate of the conveyor table, as well as the draw-in rate of a following carding means. However, a direct measured quantity can also be established by an intervening scale, for example an electronic scale. The height of the material column in the stack is, thus, also dependent on the conveying speed of the fiber flock, which will be ultimately dependent on the speed of the spiked lattice.

This known way of setting the feed weight via a plurality of parameters is relatively imprecise and subject to inertia, so that a constant quality of the fiber material cannot be guaranteed.

SUMMARY OF THE INVENTION

It is an object of the present invention to create an apparatus for producing fiber material or the like with a prescribable feed weight, wherein the control process can be implemented significantly more exactly and without long adaptation times or time delays.

This object is achieved by an improvement in an apparatus for producing fiber material or the like with a prescribable feed weight, which apparatus includes a conveyor means for delivering fiber flock to a filling stack which comprises a vibrating wall extending in a vertical direction and a displaceable wall, a stationary delivery roller being arranged in a discharge region of the filling stack, said delivery roller supplying the emerging fiber material to a delivery table. The improvements include a displaceable second delivery roller being arranged opposite and at a distance from the stationary delivery roller in the discharge region of the filling stack, a pressure sensor being provided between the stationary delivery roller and the second delivery roller, said pressure sensor providing output signals for means for controlling the displacement of the second delivery roller, for means for controlling the vibratory frequency of the vibrating wall and/or for means controlling the displacement of the displaceable wall.

Inventively, a displaceable delivery roller is arranged lying opposite and at a distance from the stationary first delivery roller in the discharge region of the filling stack, wherein the pressure sensor is provided between the two delivery rollers, this pressure sensor providing an output signal at least for controlling the displacement of the delivery roller, for controlling the displacement of the vibratory frequency of the vibrating wall and/or for the displacement of the displaceable wall. With the assistance of only one parameter, namely that of the pressure exerted by the fiber material as it passes between the two delivery rollers at the lower end of the filling stack, one, thus, succeeds in a surprisingly simple way in defining the optimum control of the apparatus parameters that essentially determine the feed weight. Thus, the pressure that is determined will indirectly provide information about the density of the material.

Advantageously, the axles of the stationary delivery roller and the second displaceable delivery roller lie essentially parallel to one another so that a uniform quality is achieved over the entire discharge region of the filling stack.

It is particularly preferred that an eccentric drive be provided for the vibratory motion of the vibrating wall, whereby the throw of the eccentric produced by the eccentric drive is adjustable and/or controllable, dependent on the signal from the pressure sensor. Since the material compression occurs due to the vibratory motion, it is precisely this density that can be influenced in an especially simple way by increasing or decreasing the throw.

In addition, a filling level sensor is preferably arranged in the filling stack. This filling level sensor can be a light barrier or an ultrasonic sound barrier.

Advantageously, the displaceable wall can also be displaceable with a movable support with infinite variability between a first position that will minimize the width of the filling stack and a second position which will maximize the width of the filling stack. A motor control for the motion of the displaceable wall is, thus, realized in a simple way.

The invention also proposes that the displaceable delivery roller is arranged adjacent or on the displaceable wall. The delivery roller and wall can, thus, be moved synchronized with one another.

An automatic control or prescribable feed of the fiber material is possible with the apparatus of the present invention in the following way. The measured signal of the scale effects the modification of the speed of the spiked lattice and, thus, the filling level in the stack. A slow spiked lattice speed thereby causes a low filling height, while a higher spiked lattice feed will cause a higher fiber flock column in the filling stack, Vibratory frequency, throw of the eccentric, shaft width and spacing of the delivery rollers remain variable given a constant filling level in the filling stack, and are adjustable in view of a filling level sensor, such as the light barrier or the ultrasound barrier. The other quantities can be varied with the assistance of the signal output by the pressure sensor.

The apparatus of the present invention can also be operated and combined with a scale, in that a motor can be introduced, as heretofore, at an inlet of the carder or at the fiber flock inlet and can then be correspondingly controlled given the setting of a constant feed weight in addition to the usual variations of speed, whereby the respective motors would then be required for the various belts. For example, more throw can be produced at the vibratory wall, as well, in order to obtain a greater compression given an unchanged admission speed or the stack width is varied given an unchanged speed. The vibratory frequency and speed of the spiked lattice can also be involved, as warranted.

Other advantages and features of the invention will be readily apparent from the following description of the preferred embodiments, the drawings and claims.

BRIEF DESCRIPTION OF THE DRAWINGS

FIGS. 4*a* and 4*b* are enlarged views showing the change in the eccentric drive in the apparatus of the present invention, wherein FIG. 4*a* shows the position for a maximum throw and FIG. 4*b* shows the position for a minimum throw.

DESCRIPTION OF THE PREFERRED EMBODIMENTS

Figure 1:
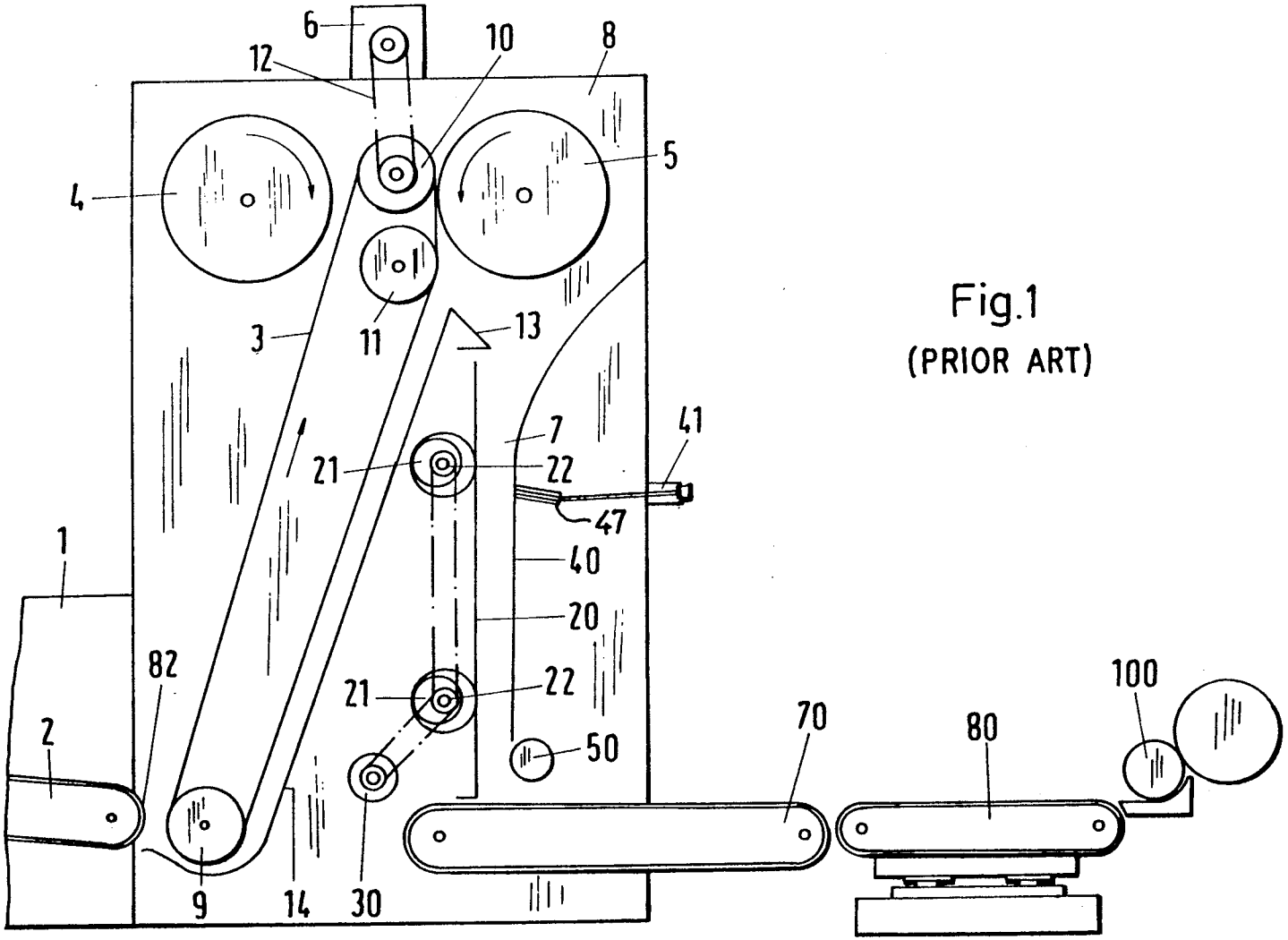
Fig.1 (PRIOR ART)
FIG. 1 is a schematic view of a vibratory stack feeder known in the prior art.

A prior art vibrating stack feeder having a housing 8 is illustrated in FIG. 1. Fiber flocks are introduced from a material box 1, which is only schematically illustrated, onto a bottom lattice 2 that is constructed as a circulating or continuous conveyor belt. The conveyor belt extends through an admission opening 82 into the housing 8 to introduce the flock into the housing 8. An end section of a spiked lattice 3 lies in the intermediate proximity of the admission opening 82 in the lower region of the housing 8. This spiked lattice 3 is, likewise, fashioned as a continuous or circulating conveyor belt, and is arranged in an ascending fashion between a tension roller 9 lying in the lower region of the housing 8 and a drive roller 10 lying in the upper region of the housing 8. An additional tension roller 1 1 is provided adjacent and under the drive roller 1 0 at a distance therefrom, wherein the axles of the drive rollers 10 and 1 1 lie essentially vertically with the drive roller 1 0 being above the roller 1 1. The drive roller 1 0 is connected by a belt 12 to a drive motor 6 that is arranged on the housing 8.

As illustrated, the drive roller 10 causes the belt 3 to pass between two oppositely rotating drums 4 and 5 that are located in the upper region of the housing 8. The roller 4, which is arranged in an ascending region of the spiked lattice or belt 3, is a leveling drum that sees to a uniform fiber occupation across the width of the spiked lattice while the drum 5 is arranged in a descending region of the spiked lattice and is a stripper drum that will separate the fibers from the spiked lattice and bring them into a filling stack 7. A guide wall 13 is provided under the tension roller 1 1 in order to guide the motion of the fiber. This guide wall is directed toward the filling stack 7 and drops downward in an oblique direction. The rest of the descending parts of the spike lattice 3 is limited by a plate 14, which follows the guide and course of the spiked lattice. This plate 14 will lead around the tension roller 9 and ends in the proximity of the admission opening 82 of the housing 8.

The filling stack 7 is formed by side walls, which are not shown, as well as a back wall fashioned as a vibrating wall 20 and by a displaceable front wall 40. The front wall 40 is displaceable via a hand wheel 41 of a setting device 47, which is mounted on the outside of the housing 8, but has a shaft in communication with the front wall 40 so that the width of the filling stack can be manually set. The vibrating wall 20 of the stack is, likewise, movable and produces the material compression on the basis of the reciprocal motion. The vibratory frequency is produced by rotation of shafts 22 with eccentrics 21 situated thereon, which eccentrics 21 are seated in a frame (not shown), which rigidly attaches the eccentric to the vibrating wall 20. The drive of the eccentric mechanism occurs with a motor 30. A delivery roller 50 will deposit the compressed fiber material onto a delivery table 70, which is arranged at the discharge opening of the filling stack 7. This delivery table 70 is constructed as a continuous conveyor belt and conducts the fiber material out of the housing 8. The delivery table 70 is followed by an electronic scale 80, with which the feed weight is identified. Carders 100 then draw the fiber material in for further processing in a fleece processing system or the like.

Figure 2:
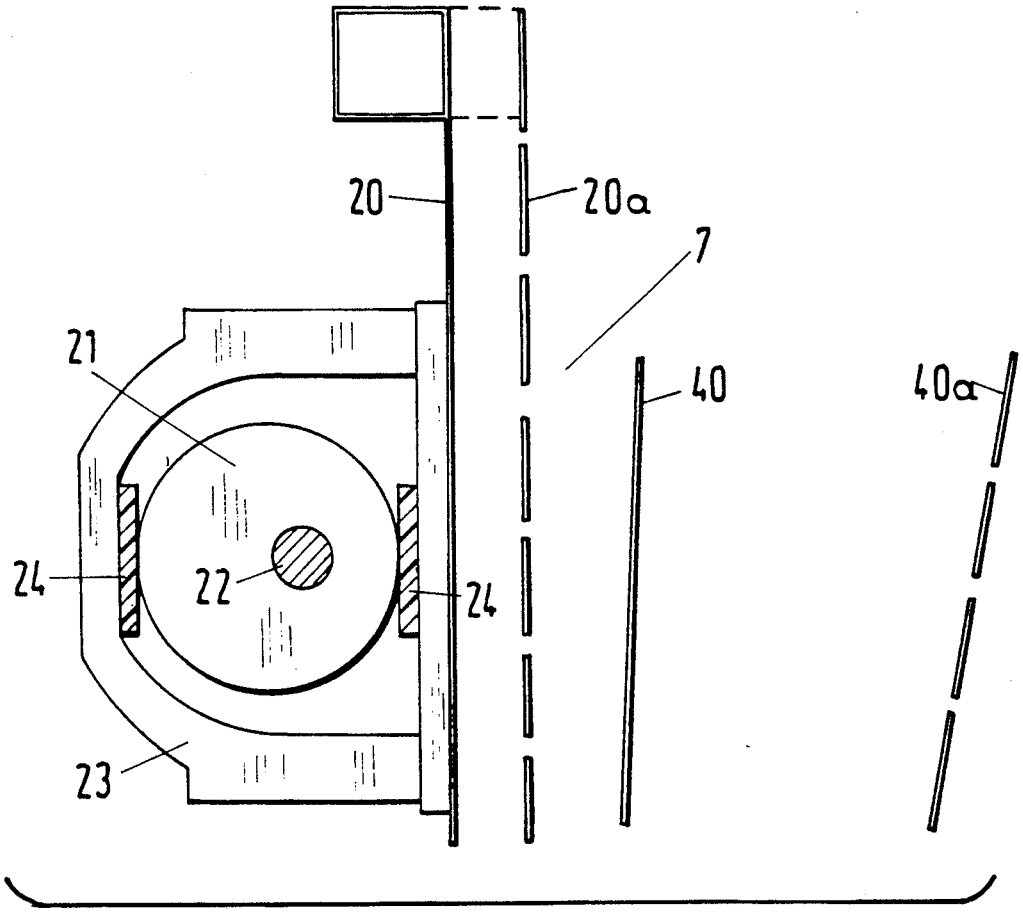
Fig.2 (PRIOR ART)
FIG. 2 is a detailed view of an eccentric drive for the vibratory stack feeder of FIG. 1.

The filling stack in the region of the eccentric mechanism is illustrated in FIG. 2. Two positions of the front wall 40 are indicated on the right side of FIG. 2, namely one position wherein a minimum gap width of the filling stack 7 is produced, which is shown in solid lines, and one position 40*a* wherein the maximum width of the filling stack is produced, which is shown in broken lines. The two extreme positions of the vibrating wall that are defined by the throw of the eccentric 21 are also schematically shown, with the farthest movement toward the displaceable front wall 40 shown in broken lines 20*a* and the farthest movement away from the front wall 40 shown in bold lines. The eccentric 21 is seated on a fixed shaft 22, which rotates in the housing 23, which is rigidly connected to the vibrating wall 20. In extreme positions, the eccentric 21 will press against sliding plates 24 lying opposite one another and which are provided on the inside of the housing 23. Thus, rotation of the shaft 22 will cause the eccentric 21 to shift the housing 23 and, thus, the plate or wall 20 between the two extreme positions.

Figure 3:
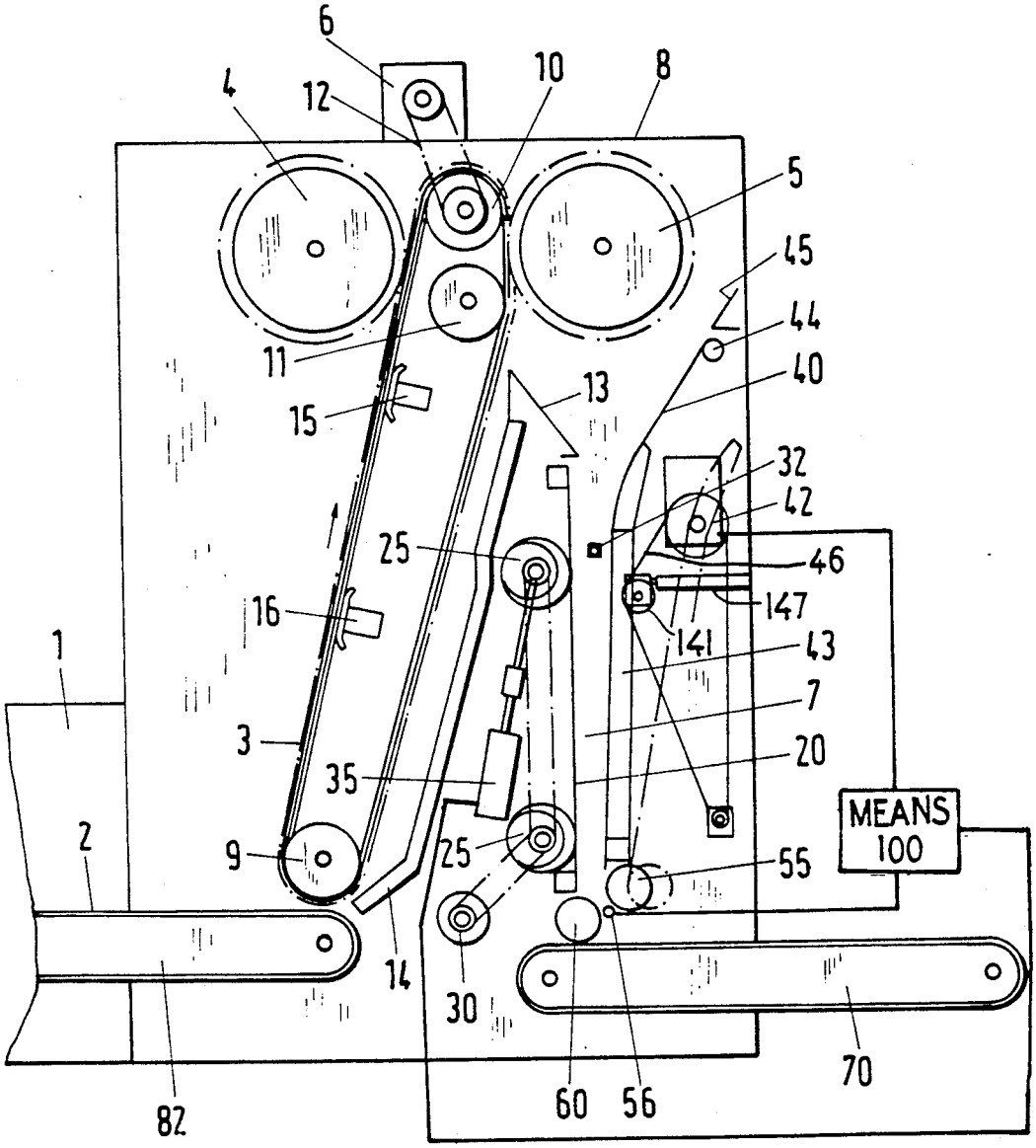
FIG. 3 is a side view of an exemplary embodiment of the inventive apparatus for producing fiber material in accordance with the present invention.

The improvements of the present invention are illustrated in FIG. 3. The fiber flocks are again introduced into the housing 8 through a material box 1 via a bottom lattice 2 that is fashioned as a continuous conveyor belt. The bottom lattice 2, thus, projects through the admission opening 82 down under the tension roller 9 for the spiked lattice 3. The spiked lattice 3 is arranged ascending in the housing 8 and is guided around a drive roller 10, as well as around an additional tension roller 11 and the previously-mentioned roller 9. Contact or support plates 15, 16 are also arranged at a distance from one another in the ascending region of the spiked lattice 3, with the inside of the spiked lattice pressing against these contact plates 15 and 16. The circulating motion of the spiked lattice 3 occurs via a drive motor 6 on the housing 8 that acts on the drive roller 10 with a belt 12. The shafts of the drive roller 10 and the tension roller 11 are arranged essentially in a vertical plane, wherein the tension roller 11 lies under the drive roller 10. A leveling drum 4 and a stripper drum 5 that have the same function as those in the previously-described apparatus are arranged in the upper region of the housing 8 at both sides of the spiked lattice 3. The fiber material taken from the spiked lattice 3 is conducted into the filling stack 7 by a guide wall 13. The filling stack 7 is formed of side walls (not shown), as well as of a vibrating wall 20, which acts as a back wall, and of a movable front wall 40. The front wall 40 is secured to a suspension 44, which is located under the stripper drum 5 and in the immediate proximity of a protective wall 45. Initially convexly curved, the front wall then ultimately proceeds essentially vertically in the housing 8. The front wall 40 presses against a support 43, which is provided in the region of the convex curvature, as well as in the following, straight region of the front wall 40. A motor 42 acts through a belt linkage 46 to rotate a wheel 141 of a setting device 147 that is connected to the support 43 and essentially pivots and displaces the support 43 together with the front wall 40. A delivery roller 55 is mounted adjacent the lower end of the front wall 40 and moves together with the front wall 40.

The guide wall 13 at the upper side of the filling stack 7 presses, on the one hand, against a plate that surrounds the descending region of the spiked lattice 3 and that ends in the region wherein the bottom lattice 2 and the spiked lattice 3 come closest to one another. The obliquely downwardly inclined guide wall 13, on the other hand, lies over the back wall 20 in the fashion of a projection, so that the guidance of the fiber flock in the filling stack 7 is guaranteed, even given a maximum throw of the vibrating wall 20.

Two eccentrics 25 are arranged and spaced from one another with one being in the upper region and the other in the lower region of the vibrating wall 20. The lower eccentric 25 is driven by a motor 30 and the upper eccentric 25 is connected to the lower eccentric and is also connected to a lifting motor 35 that can set the throw of the upper eccentric 25 with an infinite variation. For example, this can occur via a designated displacement of the shaft of the eccentric 25.

A stationary delivery roller 60 is arranged on the underside of the vibrating wall 20 opposite the delivery roller 55, so that these define a nip between each other. A pressure sensor 56 is provided in this nip, and this pressure sensor 56 indirectly identifies the density of the traversing fiber material. The delivery rollers 55 and 60 convey the fiber material onto a delivery table 70 that will conduct the fiber material out of the housing 8. A filling level sensor 32 is also arranged in the upper region of the filling stack 7. The exact position of the sensor 32 is defined by the desired filling level for the stack 7. The pressure sensor 56 provides output signals for means 100 for supplying output signals to the motor 42 which forms means for displacing the movable delivery roller 55 and the front wall 40. The means 100 also produces control signals for the motor 35 which forms means for controlling the vibration frequency of the vibrating wall 20 by charging the throw of the eccentric 35.

Figure 4A:
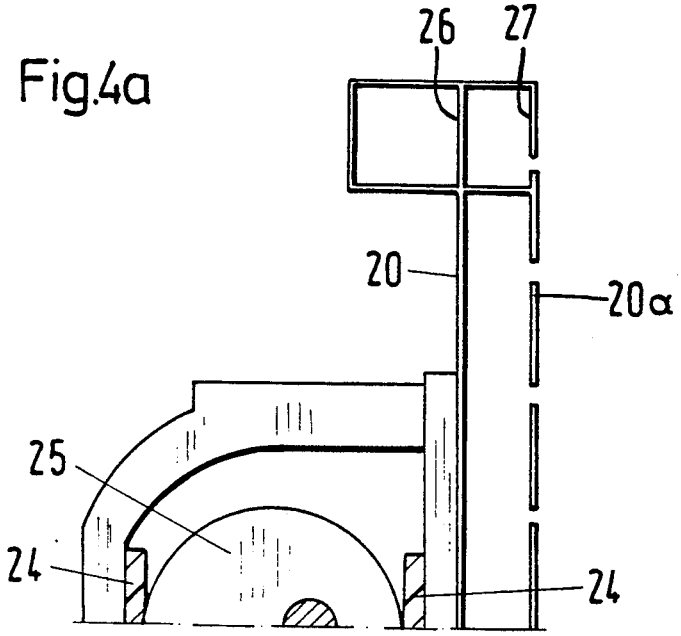
Figure 4B:
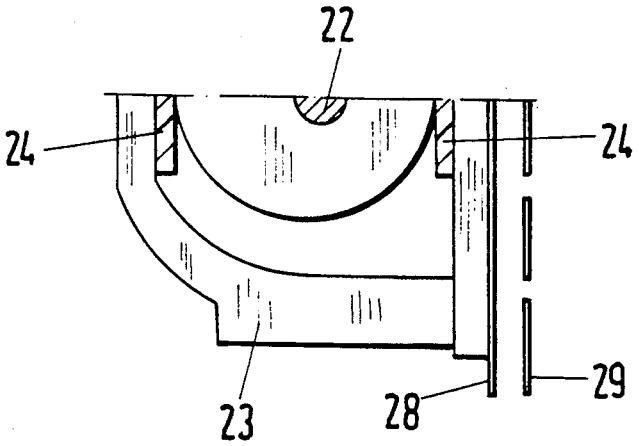

The effect of the eccentric mechanism with a variable throw is schematically illustrated in FIGS. 4*a* and 4*b*. FIG. 4*a* shows the maximum throw, wherein the vibrating wall 20 moves essentially parallel between the final position of the vibrating wall indicated by 26, and the second final position being illustrated by 27. In FIG. 4*b*, the minimum throw occurs and the vibrating wall 20 moves between two final positions 28 and 29. FIGS. 4*a* and 4*b* are joined so that the position of the shaft 22 of the eccentric 25 is the same. Otherwise, the structure of the eccentric mechanism corresponds to that of the known art, in particular the eccentric 25 is arranged in the housing 23, which is rigidly connected to the vibrating wall 20. In its extreme positions, the eccentric 25 will press against the sliding plates 24.

Figure 5:
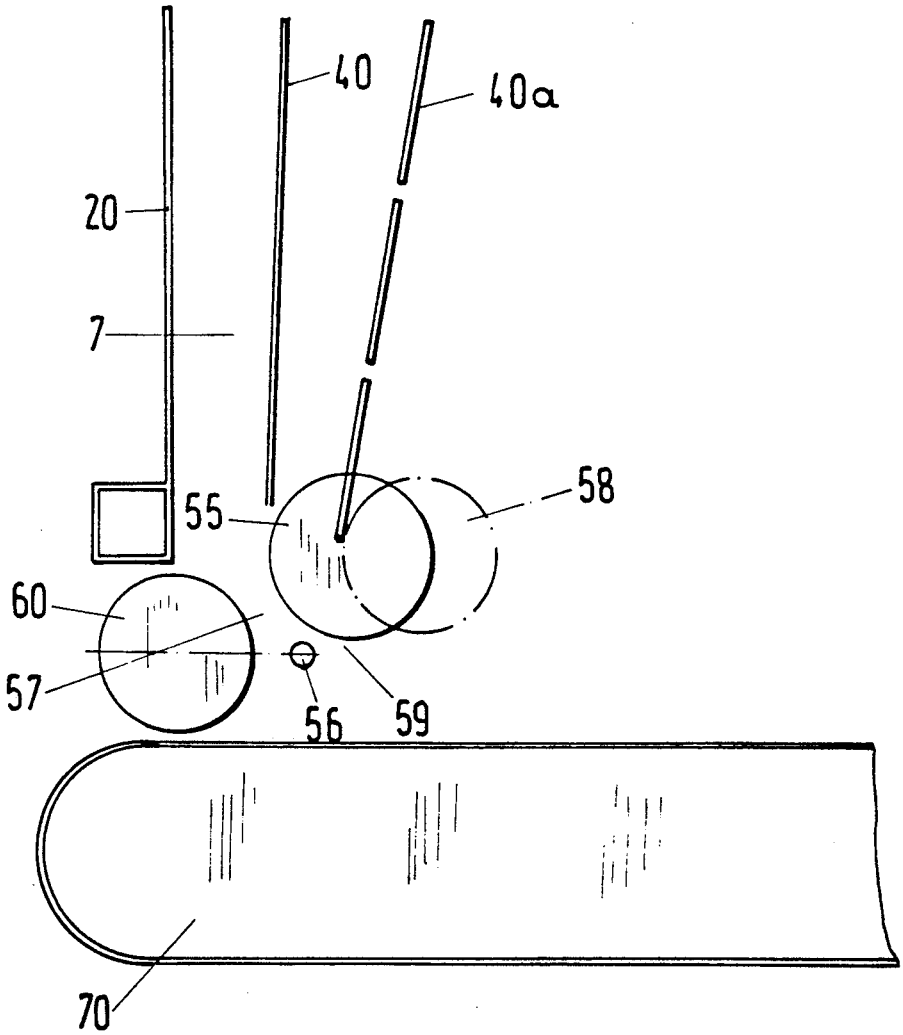
FIG. 5 is a detailed view of an outlet region of the filling stack of the apparatus of the present invention.

The discharge region of the filling stack 7 is illustrated in detail in FIG. 5. Dependent on the displacement of the front wall 40, with which the delivery roller 55 is codisplaced, the distance between the stationary delivery roller 60 and the second delivery roller 55 is also varied, in addition to the variation of the stack width between the vibrating wall 20 and the front wall 40. When the front wall 40 is positioned for the lowest stack width, a minimum gap 57 is defined. When the front wall is positioned for a maximum stack width, which is indicated in broken lines 20*a* in FIG. 5, the delivery roller 55 is situated in a position 58 and, thus, defines a gap 59 of a maximum size, together with the stationary roller 60. After traversing the respective gap wherein the pressure sensor 56 is arranged, the fiber material is deposited on the delivery table 70.

As illustrated, when the gap is narrow, such as shown at 57, the thickness of the material being deposited on the conveyor 70 is less than when the displaceable roller 55 is in the position 58 to form the wider gap 59.

Although various minor modifications may be suggested by those versed in the art, it should be understood that we wish to embody within the scope of the patent granted hereon all such modifications as reasonably and properly come within the scope of our contribution to the art.

We claim:

1. In an apparatus for producing fiber material with a prescribable feed weight, said apparatus including a conveyor means for delivering fiber flock to a filling stack which comprises a vibrating wall extending in a vertical direction with means for vibrating the wall, and a displaceable wall with means for displacing the displaceable wall, said apparatus including a stationary delivery roller being arranged in a discharge region of the filling stack, said delivery roller supplying the emerging fiber material to a delivery table, the improvements comprising a displaceable second delivery roller being arranged opposite and at a distance from the stationary delivery roller in the discharge region of the filling stack, means for displacing the second delivery roller, a pressure sensor being provided between the two delivery rollers, said pressure sensor producing output signals for controlling the means for displacing the second delivery roller, for controlling the means for vibrating the wall and for controlling the means for displacing the dispaceable wall.

2. In an apparatus according to claim 1, wherein the shafts of the stationary delivery roller and the second delivery roller lie essentially parallel to one another.

3. In an apparatus according to claim 1, wherein a filling level sensor is arranged in the filling stack.

4. In an apparatus according to claim 3, wherein the filling level sensor is a light barrier.

5. In an apparatus according to claim 3, wherein the filling level sensor is an ultrasound barrier.

6. In an apparatus according to claim 1, wherein the means for displacing the displaceable wall can displace the wall with a continuous variation by a movable support between a first position that minimizes the width of the filling stack and a second position which maximizes the width of the filling stack.

7. In an apparatus according to claim herein the displaceable second delivery roller is mounted to move with said displaceable wall.

8. In an apparatus according to claim 1, wherein the shafts of the stationary delivery roller and the second delivery roller lie essentially parallel to one another and wherein the means for vibrating the wall is formed by an eccentric drive, said eccentric drive having a throw variable and regulated, dependent on a signal from said pressure sensor.

9. In an apparatus according to claim 8, which includes a filling level sensor being arranged in the filling stack.

10. In an apparatus according to claim 9, wherein the means for displacing the displaceable wall can displaces the wall with a continuous variation by a movable support between a first position, which minimizes the width of the filling stack, and a second position, which maximizes the width of the filling stack.

11. In an apparatus according to claim 10, wherein the displaceable second delivery roller is arranged on the movable support for the displaceable wall.

12. In an apparatus according to claim 8, wherein the means for displacing the displaceable wall displaces the wall with a continuous variation by a movable support between a first position that minimizes the width of the filling stack and a second position that maximizes the width of the filling stack.

13. In an apparatus according to claim 12, wherein the displaceable second delivery roller is mounted on said movable support to move with said wall.

14. In an apparatus according to claim 1, wherein the means for vibrating the wall includes an eccentric drive with a throw being variable and being regulated, dependent on a signal from said pressure sensor.

15. In an apparatus for producing fiber materials with a prescribable feed weight, said apparatus including a conveyor means for delivering fiber flock to a filing stack which comprises a vibrating wall wiht means for vibrating the wall extending in a vertical direction and a displaceable wall with means for moving the displaceable wall, said apparatus including a stationary delivery roller being arranged in a discharge region of the filling stack, said delivery roller supplying the emerging fiber material to a delivery table, the improvements comprising a displaceable second delivery roller being arranged opposite and at a distance from the stationary delivery roller in the discharge region of the filling stack, means for displacing the second delivery roller, a pressure sensor being provided between the two delivery rollers, said pressure sensor producing output signals for controlling the means for displacing the second delivery roller.

16. In an apparatus according to claim 15, wherein the output signals also control the means for moving the displaceable wall.

17. In an apparatus according to claim 16, wherein the means for moving the displaceable wall and the means for displacing the second delivery roller are in a single means.

18. In an apparatus according to claim 15, wherein the output signals also control the means for vibrating to change the frequency of vibration.

19. In an apparatus for producing fiber material with a prescribable feed weight, said apparatus including a conveyor means for delivering fiber flock to a filling stack which comprises a vibrating wall extending in a vertical direction with means for vibrating the wall, and a displaceable wall with means for displacing the displaceable wall, said apparatus including a stationary delivery roller being arranged in a discharge region of the filling stack, said delivery roller supplying the emerging fiber material to a delivery table, the improvements comprising a displaceable second delivery roller being arranged opposite and at a distance from the stationary delivery roller in the discharge region of the filling stack, and a pressure sensor being provided between the two delivery rollers, said pressure sensor producing output signals for controlling the means for vibrating the wall.

20. In an apparatus for producing fiber material with a prescribable feed weight, said apparatus including a conveyor means for delivering fiber flock to a filling stack which comprises a vibrating wall extending in a vertical direction with means for vibrating the wall, and a displaceable wall with means for displacing the displaceable wall, said apparatus including a stationary delivery roller being arranged in a discharge region of the filling stack, said delivery roller supplying the emerging fiber material to a delivery table, the improvements comprising a displaceable second delivery roller being arranged opposite and at a distance from the stationary delivery roller in the discharge region of the filling stack, and a pressure sensor being provided between the two delivery rollers, said pressure sensor producing output signals for controlling the means for displacing the wall.

* * * * *